US006918814B2

(12) United States Patent
Katsuoka et al.

(10) Patent No.: US 6,918,814 B2
(45) Date of Patent: Jul. 19, 2005

(54) POLISHING APPARATUS

(75) Inventors: Seiji Katsuoka, Kanagawa (JP); Manabu Tsujimura, Kanagawa (JP); Kunihiko Sakurai, Kanagawa (JP); Hiroyuki Osawa, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/145,698

(22) Filed: May 16, 2002

(65) Prior Publication Data

US 2002/0124373 A1 Sep. 12, 2002

Related U.S. Application Data

(62) Division of application No. 09/984,433, filed on Oct. 30, 2001, now Pat. No. 6,413,146, which is a division of application No. 09/341,882, filed as application No. PCT/JP98/05252 on Nov. 20, 1998, now Pat. No. 6,332,826.

(30) Foreign Application Priority Data

Nov. 21, 1997 (JP) ..... 9-338035
Dec. 2, 1997 (JP) ..... 9-347129

(51) Int. Cl.[7] ..... B24B 49/00

(52) U.S. Cl. ..... 451/5; 451/6; 451/41; 451/60; 451/173; 451/174; 451/287; 451/288

(58) Field of Search ..... 451/5, 6, 41, 60, 451/173, 174, 287, 288

(56) References Cited

U.S. PATENT DOCUMENTS 5,234,867 A 8/1993 Schultz et al.
5,442,416 A 8/1995 Tateyama et al.

(Continued)

FOREIGN PATENT DOCUMENTS

| | | |
|---|---|---|
| EP | 0807492 | 3/1997 |
| GB | 2 301 544 | 12/1996 |
| JP | 1-268032 | 10/1989 |
| JP | 3-211749 | 9/1991 |
| JP | 0761387 | 3/1997 |

OTHER PUBLICATIONS

Patent Abstracts Of Japan, vol. 098, No. 001, Jan. 30, 1998 & JP 09 225815 A (Sony Corp), Sep. 2, 1997—see abstract.

Patent Abstracts of Japan, vol. 096, No. 008, Aug. 30, 1996 & JP 08 111449 (Tokyo Electron Ltd.) Apr. 30, 1996, See abstract & US 5 695 564 A (Imahashi), See Column 4, line 52—line 58; Figure 1.

Patent Abstracts of Japan, vol. 095, No. 008, Sep. 29, 1995 & JP 07 135192 A (Sony Corp.), May 23, 1995—See abstract.

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

This invention pertains to a polishing apparatus for polishing a semiconductor wafer. The apparatus comprises a storage section that is capable of receiving a workpiece to be polished and a polished workpiece. The polishing unit that polishes the workpiece includes a primary polishing table and a secondary polishing table, wherein the polishing surface of the secondary polishing table is constructed to be arranged such that at least a portion of a surface of the workpiece being polished by the polishing surface of the secondary polishing table extends beyond an edge of the polishing surface of the secondary polishing table. Also provided is a film thickness measuring device, which measures the thickness of a film formed on a polished workpiece while the polished workpiece is held by a top ring above a pusher.

9 Claims, 12 Drawing Sheets

U.S. PATENT DOCUMENTS 5,542,874 A 8/1996 Chikaki
5,551,986 A 9/1996 Jain
5,554,064 A 9/1996 Breivogel et al.
5,695,564 A 12/1997 Imahashi
5,711,818 A 1/1998 Jain
5,738,563 A * 4/1998 Shibata ..... 451/5
5,738,574 A 4/1998 Tolles et al.
5,830,045 A 11/1998 Togawa et al.
5,893,795 A 4/1999 Perlov et al.
5,899,792 A 5/1999 Yagi
6,036,582 A * 3/2000 Aizawa et al. ..... 451/41
6,116,994 A 9/2000 Ito et al.
6,136,715 A * 10/2000 Shendon et al. ..... 438/692
6,220,945 B1 4/2001 Hirokawa et al.
6,413,145 B1 * 7/2002 Pinson, II et al. ..... 451/5

* cited by examiner

POLISHING APPARATUS

This application is a divisional of U.S. application Ser. No. 09/984,433, filed Oct. 30, 2001, now U.S. Pat. No. 6,413,146, which is a divisional application of U.S. application Ser. No. 09/341,882, filed Sep. 8, 1999, now U.S. Pat. No. 6,332,826, which is a 371 of PCT/JP98/05252, filed Nov. 20, 1998.

TECHNICAL FIELD

The present invention relates to polishing apparatus in general, and relates in particular to a polishing apparatus to produce a flat and mirror polished surface on workpieces such as semiconductor wafers.

BACKGROUND ART

With increasing intensity of circuit integration in semiconductor devices in recent years, circuit lines have become finer and interline spacing has also been drastically reduced. With this trend for finer resolution in circuit fabrication, it is now necessary to provide a precision flat substrate surface because of the extreme shallow depth of focus required in optical photolithography using stepper reproduction of circuit layout. One method of obtaining a flat surface is mechano-chemical polishing carried out by pressing wafers held on a carrier against a polishing cloth mounted on a rotating turntable while dripping a solution containing abrasive powder at the interface of the wafer and the polishing cloth.

FIG. 11 shows a polishing apparatus disclosed in a Japanese Patent Laid-Open Publication, H9-117857. The facility is comprised by a pair of polishing units 101*a,* 101*b* disposed symmetrically at one end of a rectangular-shaped floor, and a loading/unloading unit including wafer cassettes 102*a,* 102*b* disposed on the opposite end of the floor for storing wafers. Transport rails 103 are disposed along a line joining the polishing units 101*a,* 101*b* and the loading/unloading unit, and alongside the rails 103, there are wafer inverters 105, 106 surrounded by respective cleaning units 107*a,* 107*b* and 108*a,* 108*b*.

Such a polishing apparatus, comprised by a pair of parallel processing lines arranged on both sides of the rails, is able to handle workpieces polished through a single step process in each line of the facility to improve its productivity. For those workpieces requiring a double step polishing, such as compound semiconductor materials requiring polishing steps using different solutions, after completing a first polishing step through one polishing line 101*a,* the workpieces are cleaned next, and then transferred over to the second line 101*b* to carry out a second polishing step. Thus, such a polishing apparatus is able to carry out a series-operation for workpieces processed in double-step polishing, and a parallel-operation for workpieces processed in single-step polishing.

Transport of workpieces in the parallel polishing process is carried out as follows. After completing a polishing operation of the polishing units 101*a*, 101*b,* the top ring (workpiece carrier) 110 rotates and moves over to the workpiece pusher (transfer device) 112 to transfer the polished workpiece. A second robot 104*b* transports the workpiece over to the cleaning units 107*a* or 107*b,* and receives an unpolished workpiece from the inverter 105, 106, and transfers it to the workpiece pusher 112. The top ring 110 receives the unpolished workpieces and moves back to the turntable 109 to begin polishing. A dresser 111 is provided to carry out reconditioning of a polishing cloth.

A polishing unit, such as the one shown in FIG. 12, is comprised by a turntable 109 having a polishing cloth 115 bonded to its top surface, and a top ring 113 for holding and pressing a wafer W onto the turntable 109. Polishing action is produced by rotating and pressing the wafer W by the top ring 113 against the rotating turntable 109 while a polishing solution Q is supplied in the interface between the wafer W and the polishing cloth 115. The polishing solution Q is held between the surface to be polished (bottom surface) of the wafer W and the polishing cloth 115 while the wafer is being polished.

In such a polishing unit, the turntable 109 and the top ring 113 are rotated at their own independent speeds, and the top ring 113 is positioned, as shown in FIG. 12, so that the inner edge of the wafer W will be off from the center of the turntable 109 at a distance "a", and the outer edge of the wafer W will be at a distance "b" from the periphery of the turntable 109, respectively. The wafer W is polished in this condition at high rotational speeds so that the surface of the wafer will be polished uniformly and quickly. Therefore, the diameter "D" of the turntable 109 is chosen to be more than double the radius "d" of the wafer W according to the following expression:

$$D=2(d+a+b).$$

Polished wafers W are stored in the wafer cassette 102*a,* 102*b* after having gone through one or more cleaning and drying steps. Cleaning methods for wafers include scrubbing with brush made of nylon or mohair, and sponges including polyvinyl alcohol (PVA).

One of the problems in the existing polishing apparatus is its productivity. To increase the through-put from such a facility, the efficiency-determining processes involving polishing at the turntable 109 must be raised. However, in the existing technology, one robot 104*b* is required to carry out a multiple duty of removing polished wafers and supplying unpolished wafers to and from two workpiece pushers 112. This is time-consuming, resulting in idle time for the turntable 109.

Therefore, there is a need to provide, as a first objective, a polishing apparatus having two parallel processing lines that carries out efficient parallel processing by minimizing the idle time for the turntable and maximizing the throughput.

Furthermore, in the existing polishing apparatus, a high relative speed between the turntable 109 and the top ring 113 is used to achieve effective polishing as well as high flatness of the wafer surface, but this high relative speed may also cause micro-scratch marks on the wafers due to abrasive particles contained in the polishing solution.

To prevent fine scratches, it is possible to consider utilizing two sets of turntables 109, and carry out polishing in two stages, by changing polishing parameters such as the material and abrasive characteristics of the polishing cloth 115, rotation speed of the turntable 109, and polishing solution. However, as mentioned above, the large size of the turntable 109 occupying a large installation space and requiring high capital cost are disadvantages of such an approach, and this type of problem is expected to become more serious in the future, as larger diameter wafers become more common.

On the other hand, it is also possible to consider using one turntable by switching polishing solutions or by reducing the rotational speed to resolve existing problems, but such approaches are not expected to lead to improved productivity, because mixing of solutions may lead to poor performance and polishing time would be lengthened.

Another problem is related to cleaning of the wafers. When the wafers are scrubbed after polishing with abrasive particles, it is difficult to remove particles of sub-micron sizes, and if the adhesion force between the wafer and particles is strong, such cleaning method is sometimes ineffective for removing such particles.

Therefore, there is a need to provide, as a second objective, a compact polishing apparatus that can provide excellent flatness and efficient cleaning.

DISCLOSURE OF INVENTION

These objectives of the present invention are realized in a polishing apparatus comprising: a storage section for storing a workpiece to be polished; at least two processing lines extending substantially in parallel from the storage section, with each line being provided with a cleaning unit and a polishing unit; a temporary storage station disposed between the cleaning unit and the polishing unit and shared by the processing lines; and at least two robotic devices disposed for each of the processing lines for transferring workpieces among the temporary storage station, the polishing unit and the cleaning unit.

Accordingly, each of the robotic devices is used to supply an unpolished wafer placed on the temporary storage station to a polishing unit, and a polished wafer in another polishing unit directly to a cleaning unit. Therefore, replacing of wafers between processes is carried out very quickly. Therefore, the productivity-limiting step of idle time for the polishing unit can be minimized, thereby enabling the through-put of the polishing apparatus to be increased.

In such a polishing apparatus, the polishing unit may be provided with a turntable, a top ling device, and a workpiece pusher for facilitating transfer of a workpiece to and from the robotic device.

In such a polishing apparatus, the top ring device may be comprised by two top rings, which can be positioned to work with the turntable and with the workpiece pusher, and a swing arm for supporting the top rings rotatably in a horizontal plane. In this case, while one top ring is performing polishing, the other top ring is in a position to exchange a polished wafer with an unpolished wafer, so that the idle time for the turntable is reduced, thereby increasing the through-put of the facility.

In such a polishing apparatus, the polishing unit may be provided with a film thickness measuring device for remotely measuring thickness of a film formed on a workpiece being held on the top ring. Adopting this arrangement will enable the amount of material removed from the surface of the workpiece to be finely controlled. In addition, the polishing unit may be provided with a buffing table having a buffing disk.

In another aspect of the invention, a polishing apparatus comprises: a storage section for storing a workpiece disposed at one end of an installation floor space; two polishing units disposed at an opposite end of the installation floor space, with each polishing unit having a turntable, a top ring device and a workpiece pusher; at least two cleaning units for cleaning polished workpieces polished in the polishing units; and a transport device for transferring workpieces between processing units, wherein a group of polishing and cleaning units and another group of polishing and cleaning units are disposed symmetrically opposite to each other across a center line extending from the one end to the opposite end of the installation floor space, and wherein the transport device comprises a temporary storage station disposed on the center line, and robotic devices disposed on both lateral sides of the temporary storage station.

In another aspect of the invention, a polishing apparatus for polishing a circular workpiece attached to a holder device, by rotating and pressing a workpiece surface against a rotating polishing surface of a circular polishing tool, comprises: a primary polishing table whose polishing surface radius is larger than a diameter of the workpiece; and a secondary polishing table whose polishing surface radius is smaller than a diameter but larger than a radius of the workpiece.

Such a polishing apparatus is used to carry out a two-step polishing operation. On the first polishing table, high speed polishing is applied to polish a workpiece as in the conventional process, while the second polishing table is used to remove micro-scratches or to carry out preliminary cleaning. On the second polishing table, although not all the workpiece surface is in contact with the polishing surface at all times, because of the oscillating motion of the workpiece, the workpiece itself is rotated so that all areas of the workpiece comes into contact with the polishing surface, and results in uniform material removal. To avoid producing a slanted polished surface, the axis of the workpiece should stay constantly on the polishing surface. The size of the secondary polishing table may be made small in comparison to the very large size of the primary polishing table, thereby providing a compact apparatus even with an additional polishing device.

In such a polishing apparatus, it may be arranged that the holder device is able to transport a workpiece to both the primary polishing table and the secondary polishing table. The secondary polishing table should be positioned within the swing trace of the wafer holding device, because it revolves about an axis to transfer the workpiece between the polishing unit and a wafer transfer position.

Another aspect of the invention is a polishing apparatus for polishing a circular workpiece attached to a holder device, by rotating and pressing a workpiece surface against a rotating polishing surface of a polishing table, wherein a radius of the polishing surface is smaller than a diameter but larger than a radius of the workpiece surface, a center of the workpiece surface stays on the polishing surface, and a distance between a center of the workpiece surface and an edge portion of the polishing surface is smaller than a radius of the workpiece surface. This arrangement is attractive for making the apparatus compact and economical.

DESCRIPTION OF THE PREFERRED EMBODIMENTS

In the following, preferred embodiments will be presented with reference to the drawings.

Figure 1:
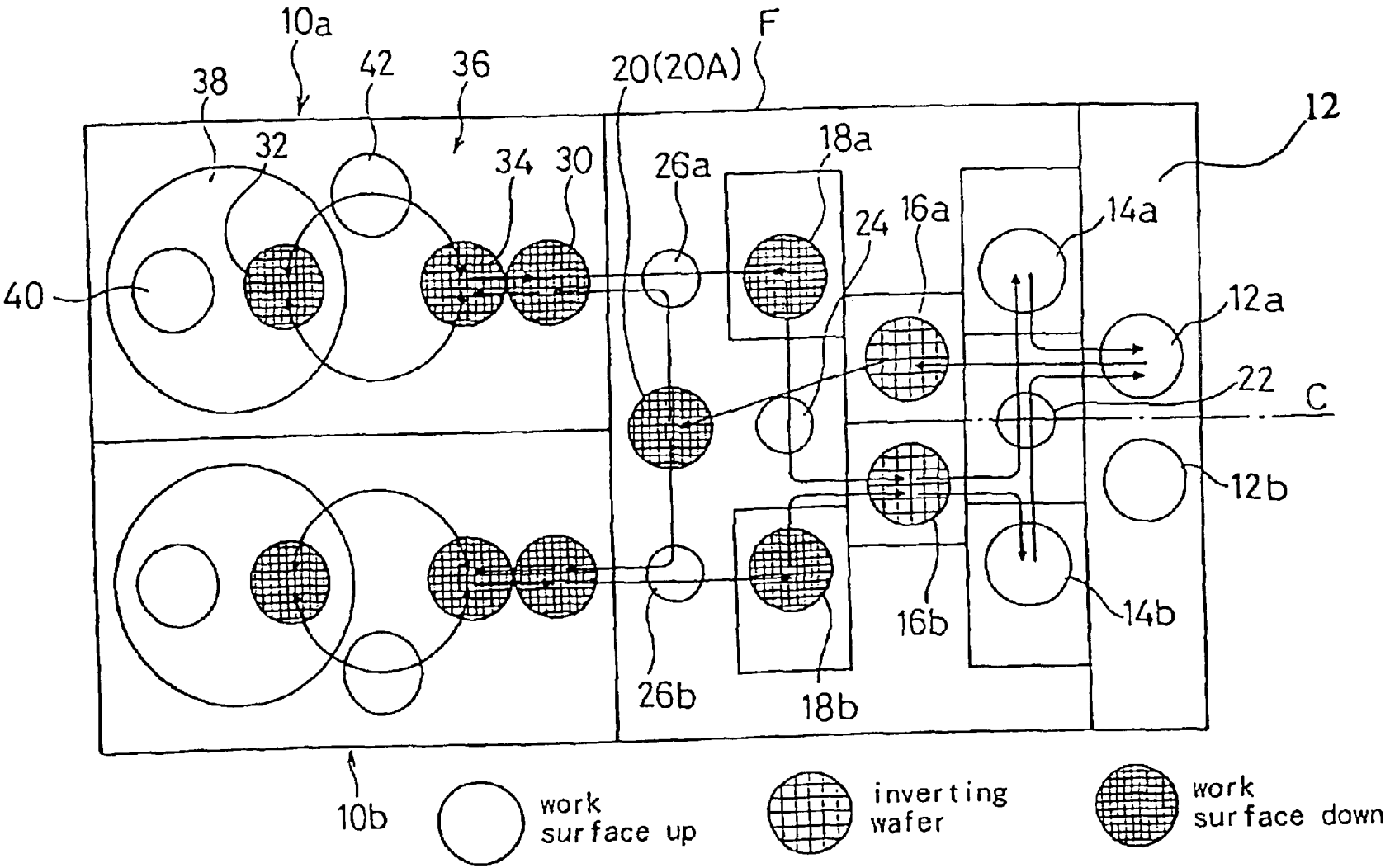
FIG. 1 is a schematic plan view of a flow of workpieces with respect to polishing stations in the present polishing apparatus.

FIG. 1 is a schematic illustration of a first embodiment of the present polishing apparatus. The present polishing apparatus is contained in a rectangular-shaped floor space F, and the constituting elements arranged on the left/right sides are disposed in a symmetrical pattern with respect the center line C. Specifically, at one end of the rectangular-shaped floor, a pair of polishing units 10*a,* 10*b* are disposed symmetrically on the left and right side, respectively, and a loading/unloading unit 12 mounting a pair of cassettes 12*a,* 12*b* for storing wafers are disposed on an opposite end of the floor. Between these two ends, there are disposed, beginning from the loading/unloading unit side, a pair of secondary cleaning units 14*a,* 14*b,* a pair of wafer inverters 16*a,* 16*b,* a pair of primary cleaning units 18*a,* 18*b,* and one temporary storage station 20. The pairs of primary and secondary cleaning units 18*a,* 18*b* and 14*a,* 14*b,* and the pair of wafer inverters 16*a,* 16*b* are disposed opposite to each other across the center line C, and stationary robots 22, 24 having arms with articulating joints are provided on the center line C. On both sides of the temporary storage station 20, stationary robots 26*a,* 26*b* are provided.

Figure 2:
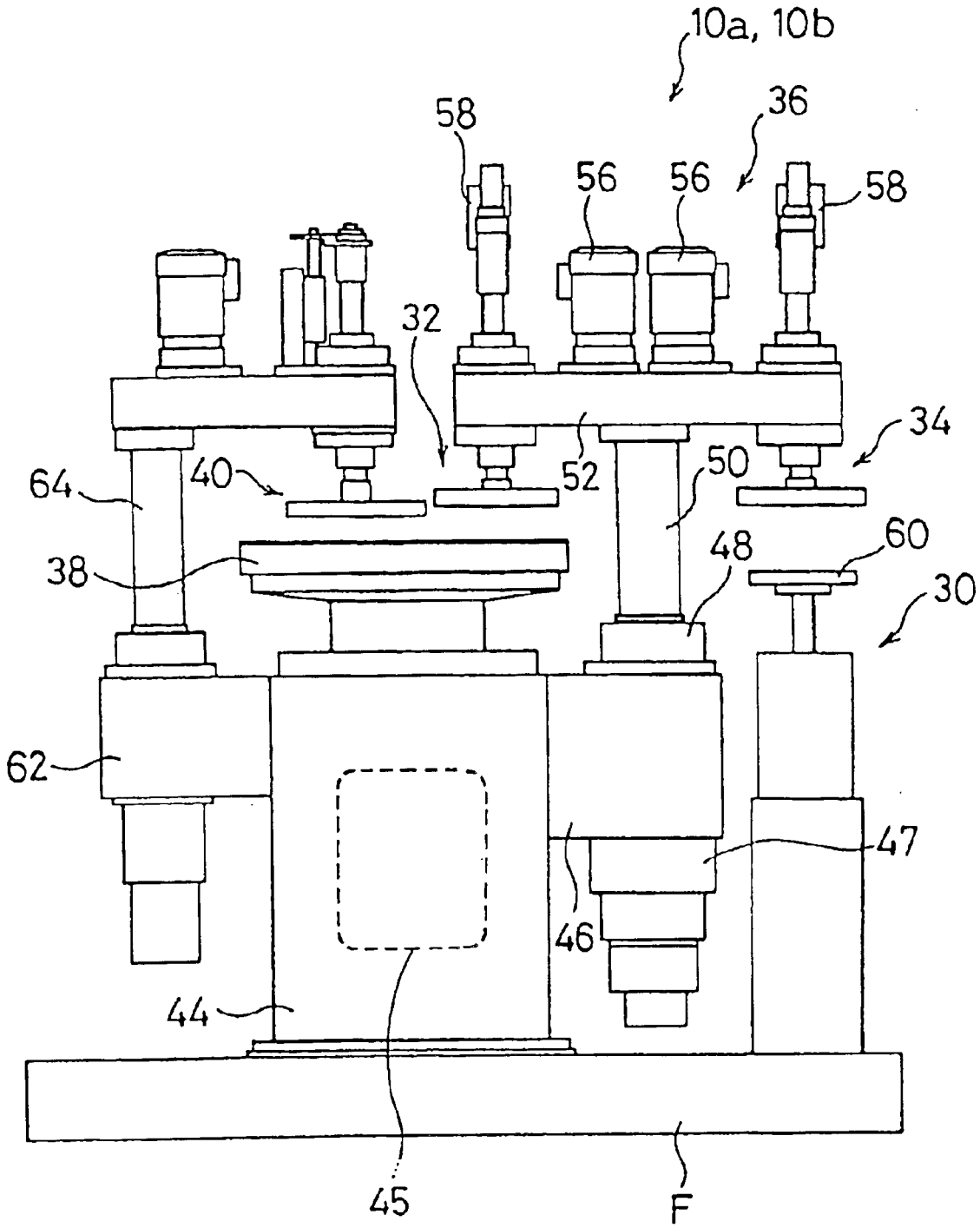
FIG. 2 is a front view of a polishing unit of the present polishing apparatus.
Figure 3:
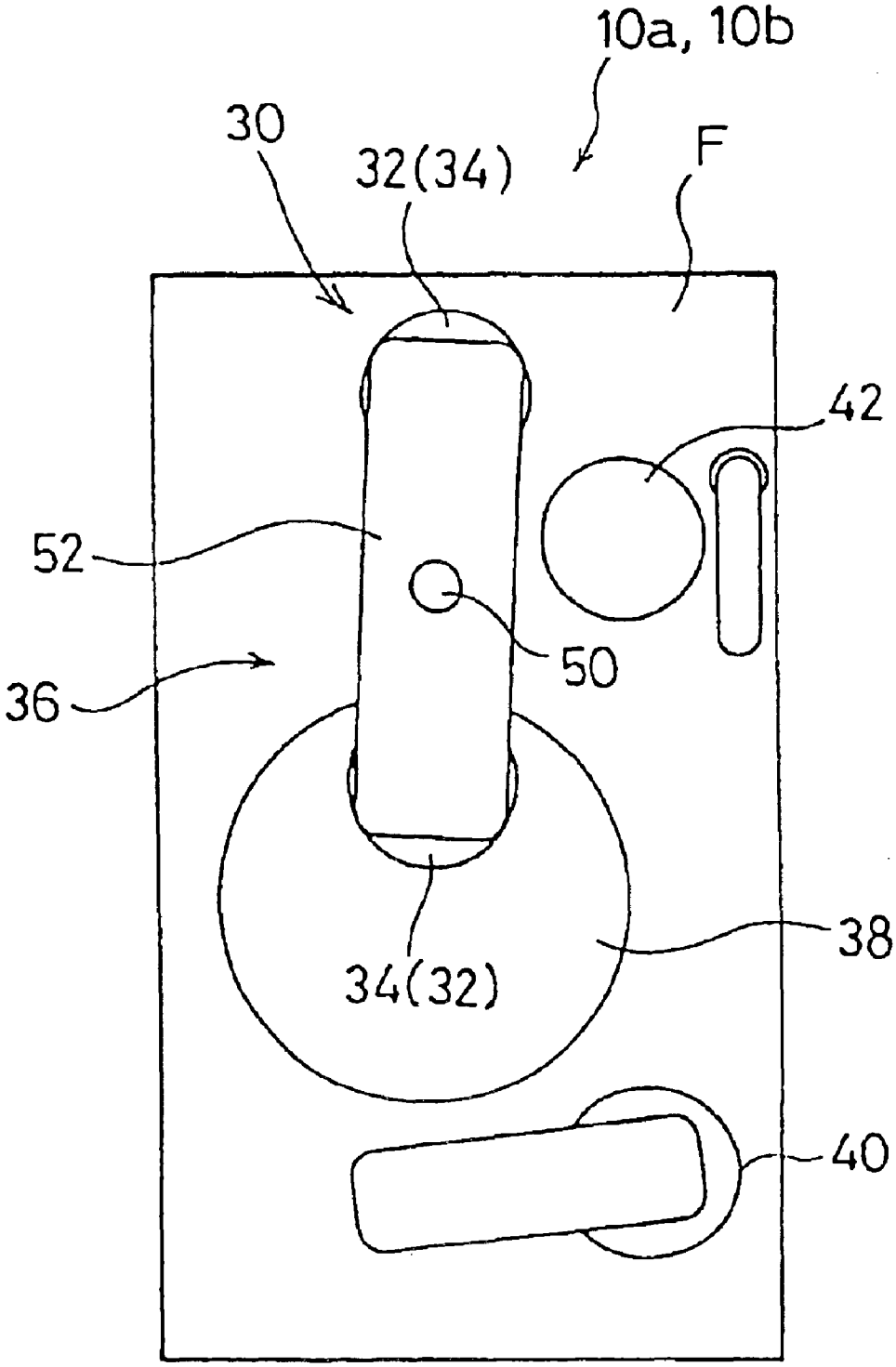
FIG. 3 is a plan view of the polishing unit.
Figure 4A:
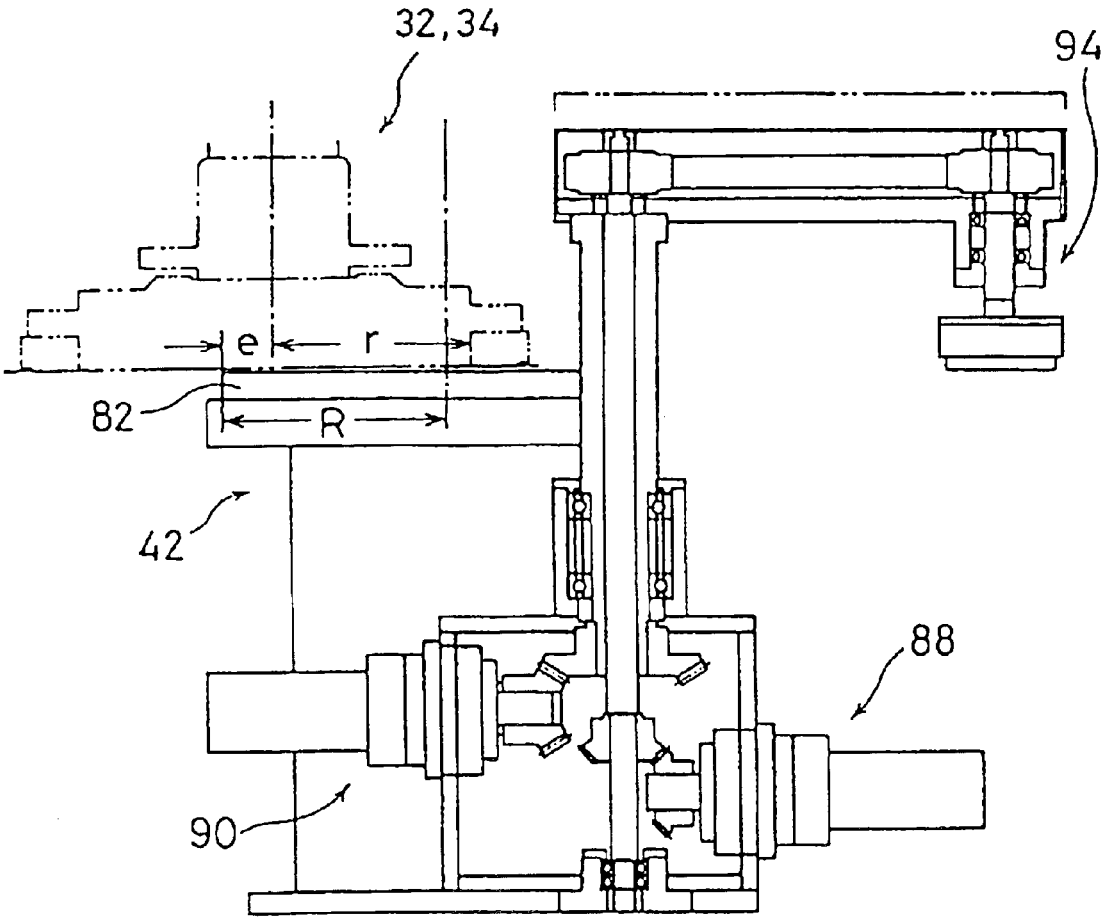
FIG. 4A is a side view of a buffing unit.
Figure 4B:
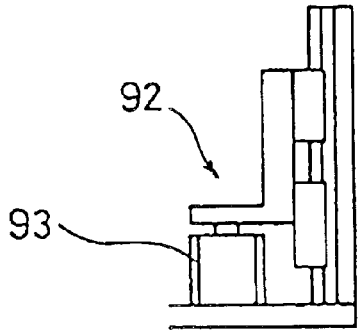
FIG. 4B is a side view of a dresser elevating device.
Figure 5A:
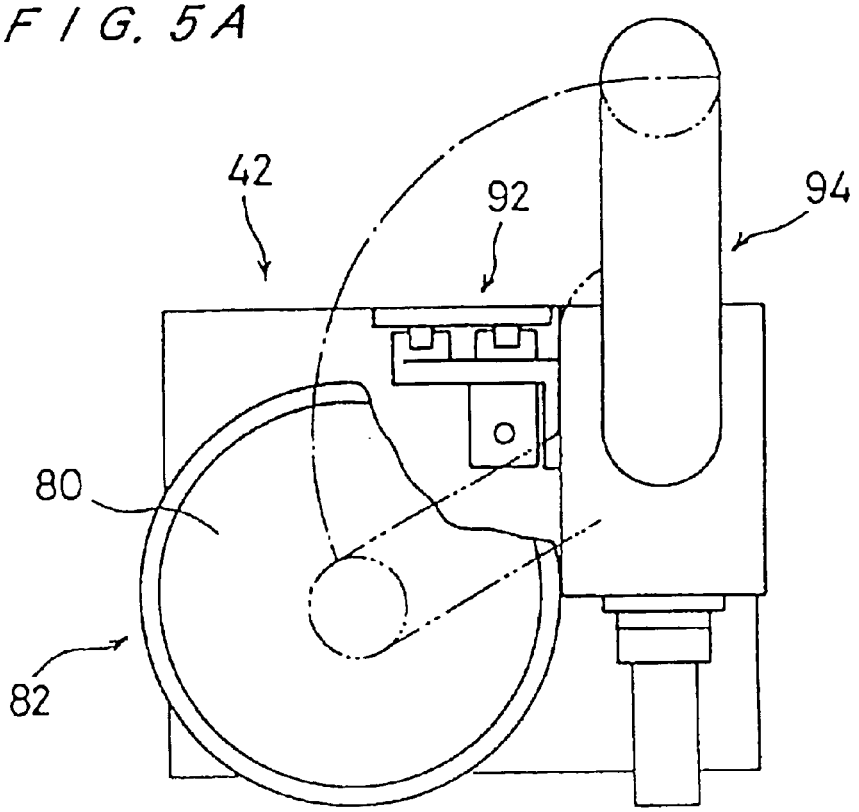
FIG. 5A is a plan view of the buffing unit.
Figure 5B:
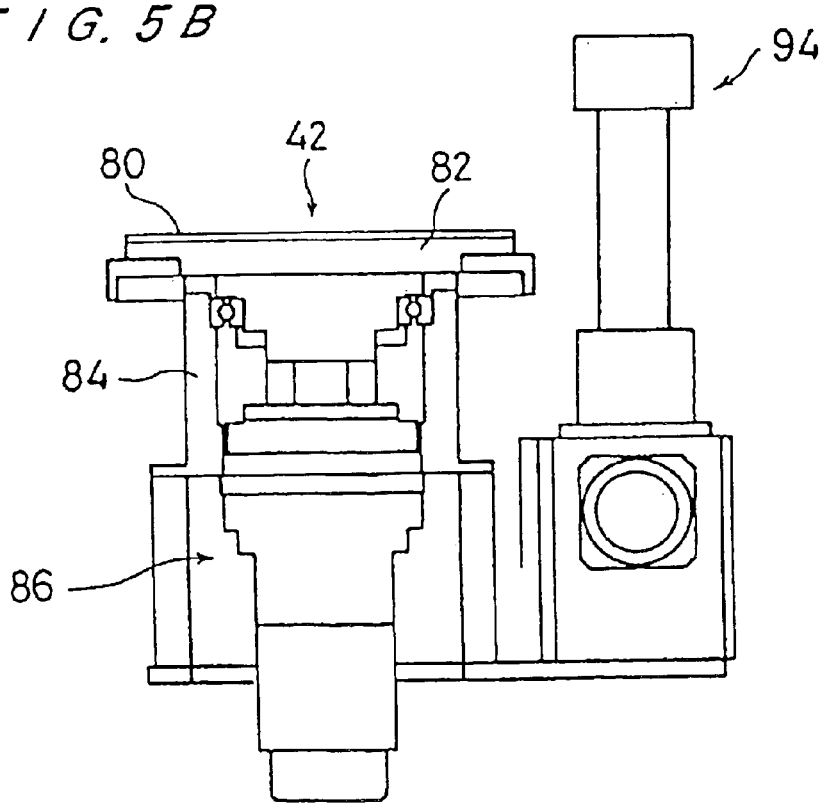
FIG. 5B is a side view of the buffing unit.

As shown in FIGS. 2 and 3, each of the polishing units 10*a,* 10*b* is provided with a set of operational devices, disposed approximately parallel to the center line, and comprised by: a workpiece pusher 30 for transferring a workpiece W; a top ring device 36 having two top rings 32, 34; a turntable (primary polishing table) 38 having an abrading tool on its top surface; and a dresser 40 for reconditioning the abrading tool. Also, in this embodiment, a buffing table (final polishing table) 42 for performing buffing (final polishing) is disposed next to the top ring device 36.

As shown in FIG. 2, the top ring device 36 is comprised by: a vertical support shaft 50 rotatably supported by a base 48 mounted on a bracket 46 laterally protruding from a turntable support base 44; a horizontally extending swing arm 52 attached to the top end of the support shaft 50; and the pair of top rings 32, 34 attached to both ends of the swing arm 52. A swing arm drive motor 47 for oscillating the swing arm around the support shaft 50 is provided in the bracket 46. Each of the top rings 32, 34 has a suction device on the bottom surface to hold a workpiece by vacuum suction, each is driven by its own drive motor 56 so as to enable each to rotate horizontally, and each can also be raised or lowered by using an air cylinder 58, independently of the other.

Figure 12:
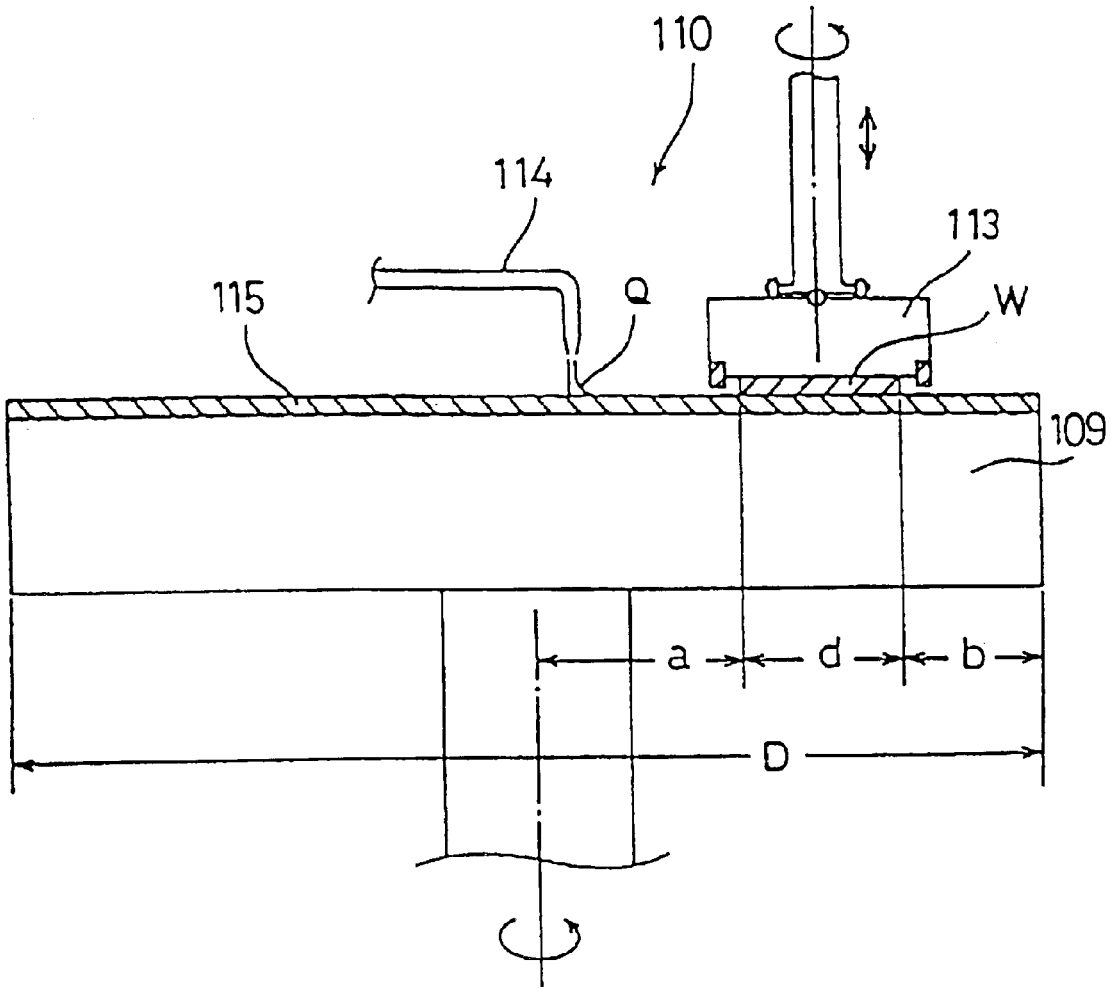
FIG. 12 PRIOR ART
FIG. 12 is a schematic side view of a conventional polishing apparatus.

Turntable 38 is a rotatable polishing table having a polishing cloth mounted on the top surface, which is basically the same as the turntable shown in FIG. 12, and includes a support base 44 for supporting the polishing table, a turntable drive motor 45, and a polishing solution supply nozzle.

As shown in FIGS. 4A, 4B, 5A and 5B, buffing table 42 includes a small diameter buffing disk 82 having a buffing cloth 80 on its top surface, and is rotatable by virtue of a driving device 86 contained in a housing 84. A dresser 94 includes: a rotation driver 88; swing device 90; and an elevating device 92, with an air cylinder 93 provided adjacent the buffing table 42. The size of the buffing table 42 is such that the radius "R" of the polishing surface is smaller than the diameter "2r" of a workpiece but is larger than its radius "r".

Figure 6:
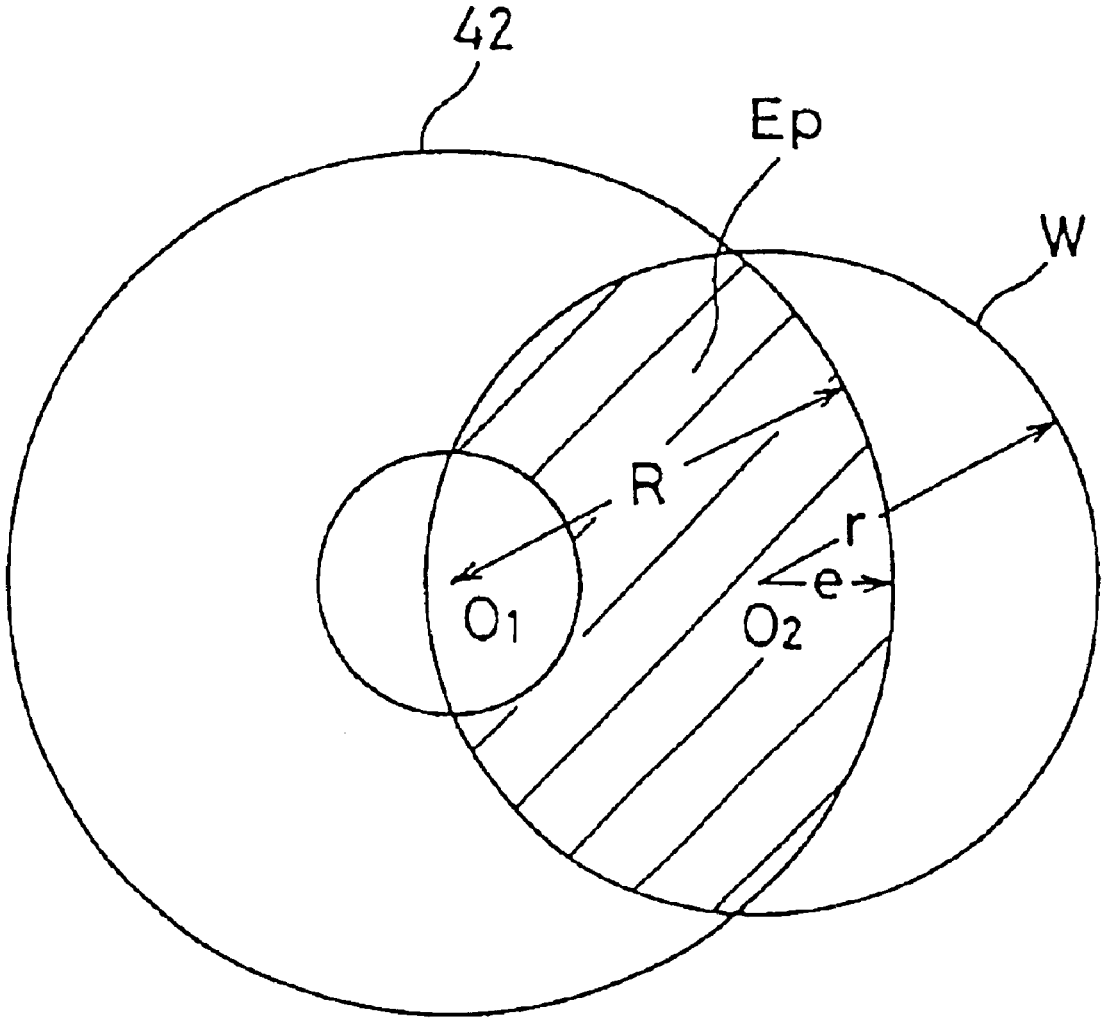
FIG. 6 is a schematic plan view to show relative positions of a buffing table and the workpiece.

Buffing table 42 is used to perform a secondary polishing step on a wafer W which has been through the primary polishing step. The secondary polishing is a finish polishing step carried out by using either a polishing solution containing polishing particles, pure water in case of a "water polish", or a certain chemical solution. In the example shown in FIG. 4A, finish polishing is performed by placing the center of the wafer W at a distance "e" from an edge of the buffing disk 82 to carry out polishing and cleaning. The magnitude of the distance "e" is small in comparison to the radius "r" of the workpiece W. Therefore, as shown in FIG. 6, the surface to be polished is exposed outside of the buffing disk 82 in a shape resembling a quarter moon with a maximum width "(r−e)".

In such a setup, the outer peripheral area of the polishing surface of the buffing cloth 80 attached on the disk 82 can provide a maximum polishing ability, where the speed of the workpiece surface thereat relative to the speed of the workpiece surface at the inner regions of the disk 82 is larger. This polishing region is termed an effective polishing area Ep, as illustrated in FIG. 6. Because the workpiece surface is also rotated, each section of the workpiece surface is successively brought into contact with the effective polishing area Ep, and ultimately, the amount of material removed from all sections of the workpiece surface is averaged.

To improve the degree of precision of the buffing operation, die distance "e" and rotational speeds, as well as polishing duration of the workpiece, should be adjusted accordingly. Polishing can be performed while adjusting the distance "e" by rotating the swing arm 52 of the top rings 32, 34, or corrective polishing can be carried out in the same manner in addition to the normal polishing operation.

With reference to FIG. 3, the workpiece pusher 30 is positioned on the opposite side of the support shaft 50 with respect to the turntable 38, and when one top ring 32 (or 34) is on the turntable 38, the other top ring 34 (or 32) is directly above the workpiece pusher 30. Workpiece pusher 30 has a workpiece table 60 which can be raised or lowered, and serves to transfer workpieces between the top rings 32, 34 and robots 26*a,* 26*b*. With reference to FIG. 2, the bracket 62 extending from the base 44 opposite to the top rings 32, 34 rotatably supports a dresser shaft 64 for the dresser 40.

Figure 7:
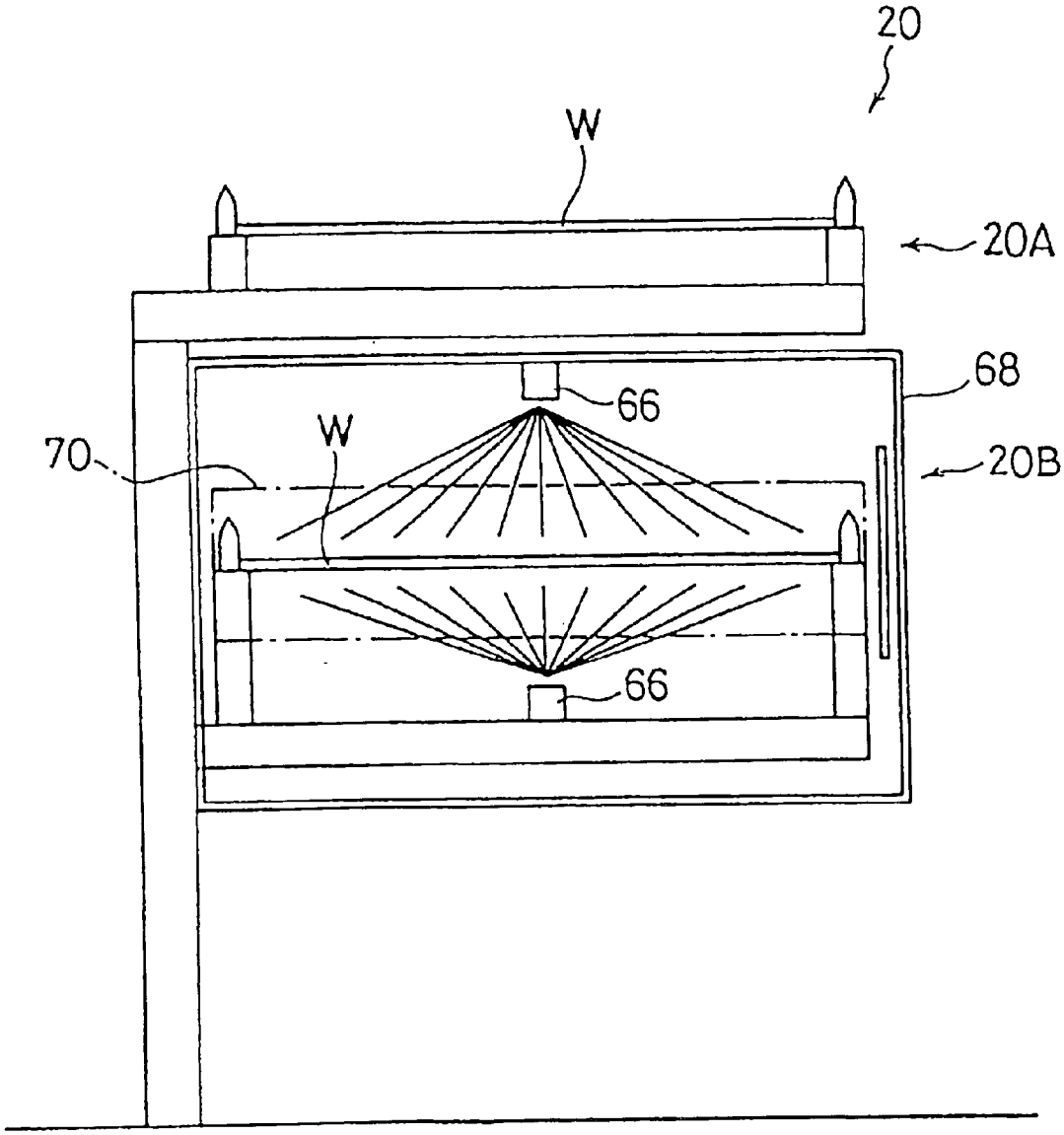
FIG. 7 is a cross sectional view of a temporary storage station.

As shown in FIG. 7, the temporary storage station 20 is divided into upper and lower levels. The upper level is a dry station 20A for placing dry workpieces, and the lower level is a wet station 20B for placing wet workpieces. The dry station 20A is an open structure, but the wet station 20B is a closed box structure 68 having spray nozzles 66 disposed above and below the workpiece W. The workpieces W are handled through a gate 70 provided on the side of the box structure 68.

The cleaning units 14*a,* 14*b* and 18*a,* 18*b* can be selected to suit applications, but in this embodiment, the primary cleaning units 18*a,* 18*b* beside the polishing units 10*a*, 10*b* are of the sponge roller type to scrub both front and back surfaces of a wafer, for example, and the secondary cleaning units 14*a,* 14*b* are made to rotate the wafer horizontally by holding the edge of the wafer while supplying a cleaning solution thereto. The latter device can also serve as a spin dryer for dewatering the wafer by centrifugal force.

The wafer inverters 16*a,* 16*b* are needed in this embodiment, because of the wafer storage method using cassettes 12*a,* 12*b,* and their working relation to the handling mechanism of the robots, but such inverters are not needed for a system where the polished wafers are transported with the polished surface always facing downward, for example. Also, such inverters 16*a,* 16*b* are not needed where the robots comprise inverting facilities. In this embodiment, the two wafer inverters 16*a,* 16*b* are assigned separately to handling dry wafers and to handling wet wafers.

In this embodiment, four robots 22, 24, 26*a,* 26*b* are provided, and they are of a stationary type operating with articulating arms having a hand at the end of the arms. The first robot 22 handles workpieces for a pair of cassettes 12*a,* 12*b,* secondary cleaning units 14*a,* 14*b* and the wafer inverters 16*a,* 16*b*. The second robot 24 handles workpieces for the pair of wafer inverters 16*a,* 16*b,* primary cleaning units 18*a,* 18*b,* and temporary storage station 20. The third and fourth robots 26*a,* 26*b* handle workpieces for temporary storage station 20, either one of the cleaning units 18*a* or 18*b,* and either one of the workpiece pushers 30.

The polishing apparatus can be used for series or parallel operation as explained in the following. FIG. 1 shows flow of workpieces W in parallel operation using one cassette in the loading/unloading unit. In the following description, the processing line which is in the top section in FIG. 1 is designated as the "right" processing line, and the processing line which is in the bottom section is designated as the "left" processing line. Here, wafer (workpiece) W is shown by a blank circle when its work surface (polished surface) is directed upwards, by a densely meshed circle when its work surface is directed downwards, and by a sparsely meshed circle when it is inverted.

The flow of workpieces (semiconductor wafers) W in the right processing line for parallel processing is as follows: right cassette 12*a*→first robot 22→dry inverter 16*a*→second robot 24→dry station 20A→third robot 26*a*→workpiece pusher 30 for right polishing unit 10*a*→top ring 32 or 34→polishing on turntable 38→if necessary, buffing on buffing table 42→workpiece pusher 30→third robot 26*a*→primary cleaning unit 18*a*→second robot 24→wet inverter 16*b*→first robot 22→secondary cleaning unit 14*a*→right cassette 12*a*.

Figure 8A:
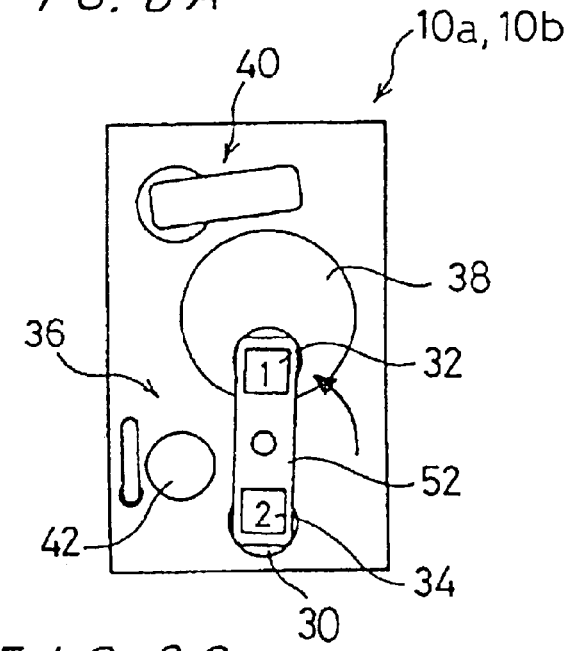
FIGS. 8A–8D are plan views to show die actions of the polishing unit.
Figure 8B:
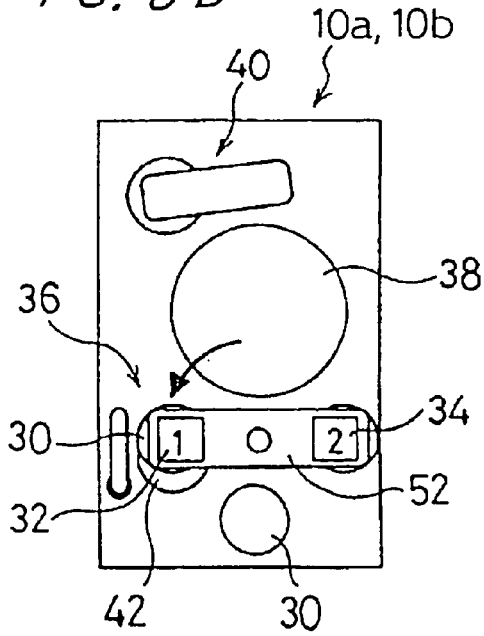

Processing flow in each polishing unit 10*a,* 10*b* will be explained with reference to FIGS. 8A–8C. Workpiece pusher 30 already is provided with anew unpolished wafer delivered by the third robot 26*a* (or fourth robot 26*b*). As shown in FIG. 8A, polishing is performed by using the top ring 32 holding the wafer, and during this time, the other top ring 34 is above the workpiece pusher 30 and receives an unpolished wafer. After finishing polishing on the turntable 38, top ring 32 moves over to the buffing table 42 by the swing action of the swing arm 52, as shown in FIG. 8B, to carry out buffing, dual-purpose water polishing for concurrently performing finishing, as well as cleaning. The wafer may also be transferred directly by the workpiece pusher 30 after the primary polishing.

Figure 8C:
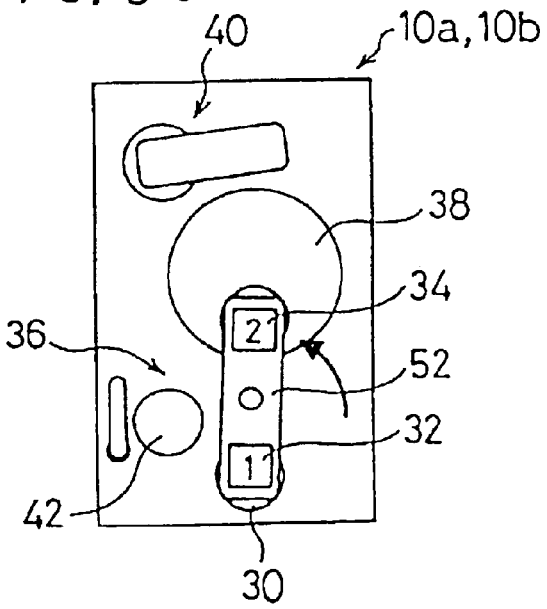
Figure 8D:
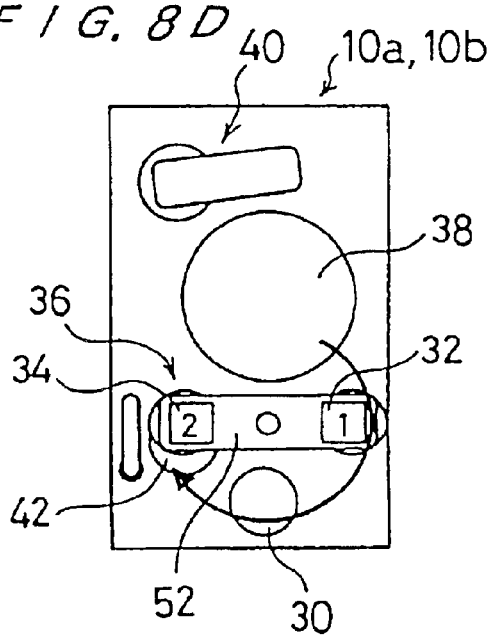

When the water polishing is finished, the swing arm 52 is rotated and the top ring 32 is moved directly over the workpiece pusher 30, as shown in FIG. 8C. Then, the polished wafer is transferred to the workpiece pusher 30 by either lowering the top ring 32 or raising the workpiece pusher 30. The polished wafer is replaced with a new unpolished wafer by using third robot 26*a* (or fourth robot 26*b*). During this period, the other top ring 34 is moved over to the turntable 38, and the wafer is polished on the turntable 38. Further, as shown in FIG. 8D, the wafer moves over to the buffing table 42 by the swing action of the swing arm 52. The polished wafer is water polished for finishing and cleaning, and the process begins all over from the step shown in FIG. 8A.

In the above process, because robots 26*a,* 26*b* are provided for each processing line for handling the wafers for polishing units 10*a,* 10*b,* the polished wafer on the workpiece pusher 30 is quickly exchanged with a new unpolished wafer. Therefore, there is no waiting time for the top ring 32, 34 for the next wafer to be polished, and the idle time for the turntable 38 is reduced.

On the contrary, since the wafer exchange is rapidly performed, top rings 32, 34 may wait for the turntable 38 to finish polishing while holding an unpolished wafer by vacuum. In this case, if the wafer is clamped by vacuum for a long time, a backing film provided between the wafer and the top ring 32, 34 will be deformed. Therefore, in this embodiment, the top rings 32, 34 are programmed to release the vacuum when a long term waiting is expected. The wafer is maintained on the lower surface of the top rings 32, 34 by remaining adhesion forces of wet backing film.

Also, in this embodiment, because the top ring device 36 is provided with two top rings 32, 34 disposed on the both ends of the swing arm 52, while one wafer is being processed by one top ring, the wafer on the other top ring is replaced with a new unpolished wafer. Therefore, there is no need to wait for the top rings 32, 34 for the wafer to be transferred for processing. Therefore, the through-put of the turntable 38 is increased, thereby enabling it to perform a high efficiency parallel operation.

Figure 11:
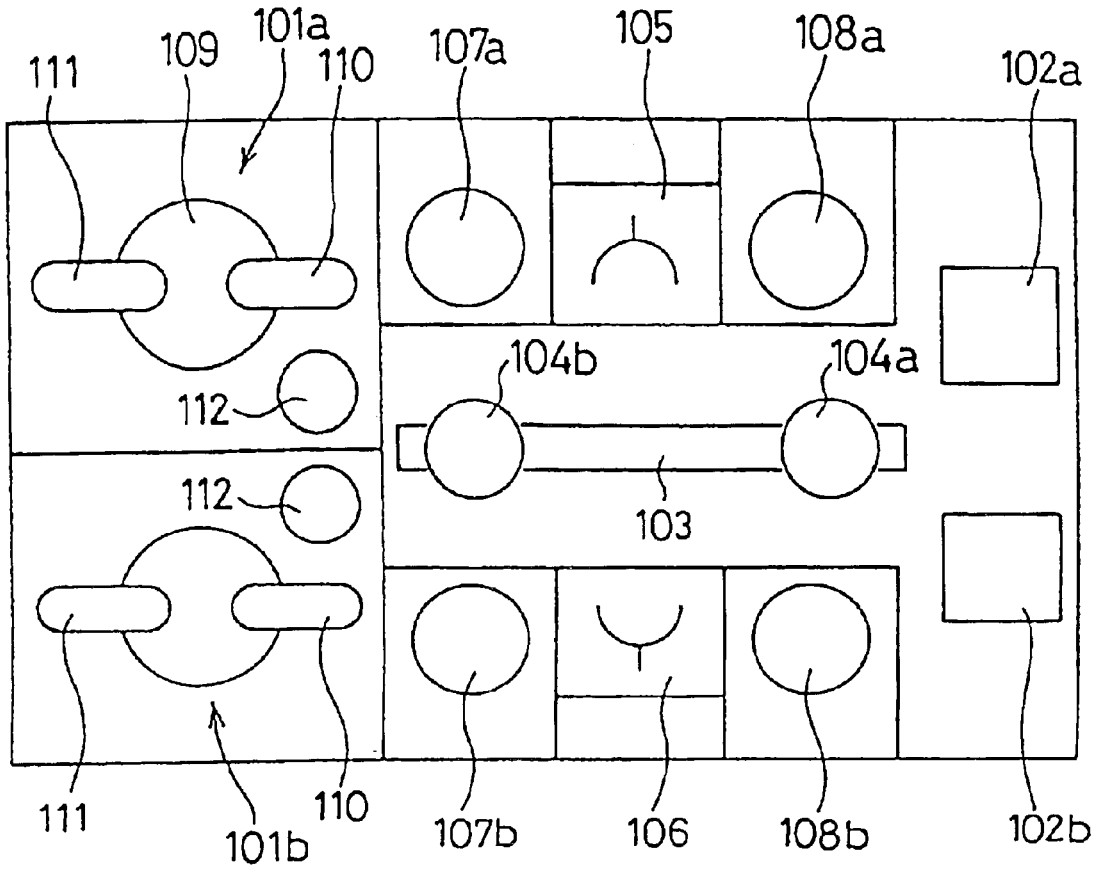
FIG. 11 PRIOR ART
FIG. 11 is a schematic plan view of a conventional polishing apparatus.

Through-put by the facility shown in FIG. 1 will be compared with that by the conventional facility shown in FIG. 11. Assume that polishing time of a wafer is two minutes, and that cleaning is carried out by primary and secondary cleaning steps. In the conventional setup, forty wafers are polished in one hour while in the present facility, fifty three wafers are polished. Comparing the through-put per unit area of installation space, it is 7.4 wafers/$m^2$·hour for the conventional system, while in the present facility, it is 7.9 wafers/$m^2$·hour.

Figure 9:
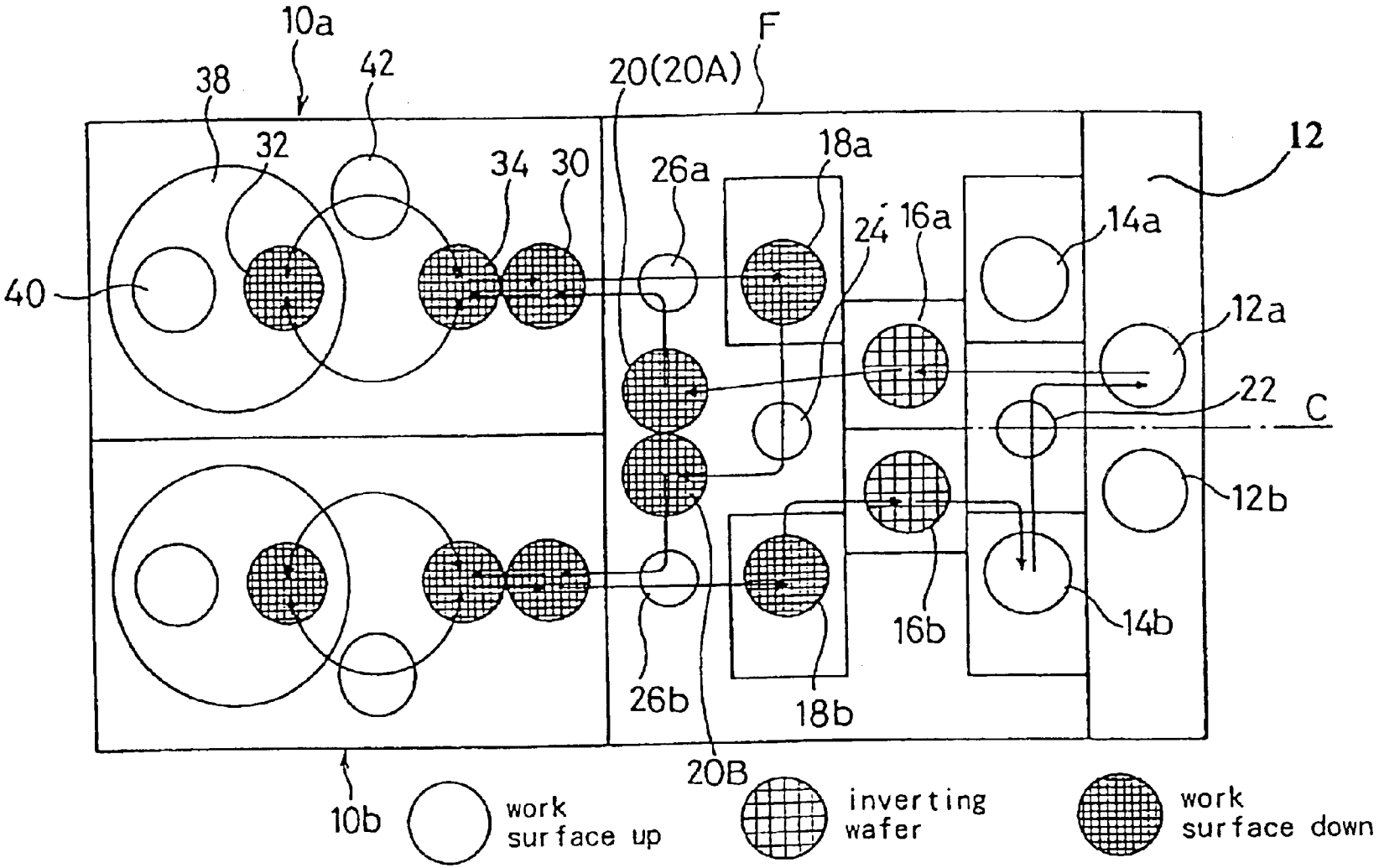
FIG. 9 is a plan view of another example of a flow of workpieces with respect to polishing stations in the present polishing apparatus.

FIG. 9 shows a flow process for two-step polishing, i.e ., a series operation. The process is as follows: right cassette 12*a*→first robot 22→dry inverter 16*a*→second robot 24→dry station 20A→third robot 26*a*→first polishing unit 10*a*→third robot 26*a*→right primary cleaning unit 18*a*→second robot 24→wet station 20B→third robot 26*b*→secondary polishing unit 10*b*→third robot 26*b*→left primary cleaning unit 18*b*→second robot 24→wet inverter 16*b*→first robot 22→left secondary cleaning unit 14*b*→first robot 22→right cassette 12*a*.

In this series processing operation, because a wet wafer is supplied to polishing unit 10*b,* the dry station 20A and the wet station 20B are separately used for placing dry wafers and wet wafers, respectively. In the wet station 20B, the top and bottom surfaces of the wafer W are rinsed with a rinsing solution to prevent drying of the polished wafer. It should be noted that the wet and dry stations 20A, 20B are separately shown in FIG. 9 for convenience in flow illustration, but they are stacked vertically, as shown in FIG. 7.

Figure 10:
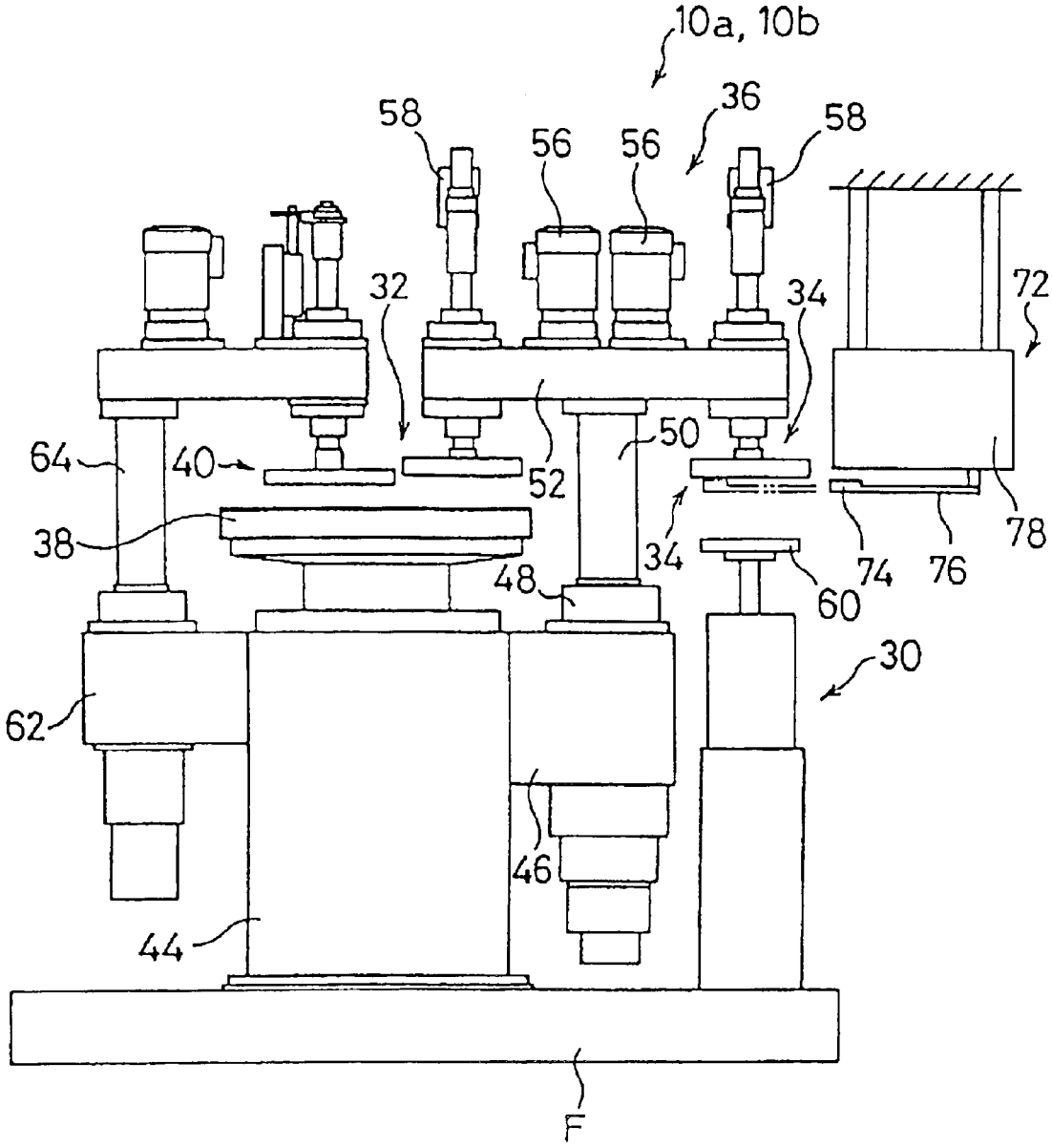
FIG. 10 is a front view of another embodiment of the polishing apparatus.

FIG. 10 shows another embodiment according to the present invention. In this polishing unit, a film thickness measuring device 72 is provided adjacent the top ring 34 located above the workpiece pusher 30 for measuring the film thickness of a wafer held in the top ring 34. The film thickness measuring device 72 is comprised by: an optical head 74 attached at the tip of an arm 76 for performing non-contact measurement of film thickness; and a positioning device 78 such as an x-y table for moving the arm 76 along the workpiece surface.

Using this arrangement, it is possible to measure film thickness fabricated on a polished wafer held on the top ring 34 when the swing arm 52 is rotated in position shown in FIG. 10. The thickness measurement provides a basis for determining the amount of material removed so that, if necessary, polishing time for the next wafer may be adjusted by a feedback control device. Or, if the value has not yet reached an allowable range, a control device may rearrange polishing schedule so that it can be repolished. The advantage is that there is no need to provide a separate space for determining the film thickness of a polished wafer, because the thickness can be determined in-place above the workpiece pusher 30. The time required to exchange the wafers by the third or fourth robots 26*a,* 26*b* is shorter than the time required by the turntable 38 to polish a wafer, and therefore, such film measurement can be performed during this time without generating any down time of the line.

INDUSTRIAL APPLICABILITY

The present invention is useful for polishing workpieces, such as semiconductor wafers, glass plates and liquid crystal display panels which require a high surface flatness.

What is claimed is:

1. A polishing apparatus comprising:

polishing tables;

a top ring device including top rings, each of said top rings for holding a workpiece during a polishing operation;

a temporary storage station for receiving a workpiece to be polished or a polished workpiece; and a pusher for transferring the workpiece to be polished or the polished workpiece between said top ring device and said pusher, wherein said top ring device is constructed and arranged such that when one of said top rings is positioned above said pusher, to receive a workpiece to be polished therefrom, another of said top rings is positioned to hold a workpiece to allow this workpiece to be polished by one of said polishing tables.

2. A polishing apparatus comprising:

polishing tables;

a top ring device including top rings, each of said top rings for holding a workpiece during a polishing operation;

a temporary storage station for receiving a workpiece to be polished or a polished workpiece; and a pusher for transferring the workpiece to be polished or the polished workpiece between said top ring device and said pusher, wherein said temporary storage station comprises a mechanism to prevent the polished workpiece from being dried.

3. A polishing apparatus comprising:

a polishing table;

at least one top ring for holding a workpiece during a polishing operation;

cleaning units for cleaning a polished workpiece at multiple stages; and a temporary storage station for receiving a polished workpiece, wherein said temporary storage station comprises a spray nozzle for rinsing the polished workpiece.

4. The polishing apparatus according to claim 3, further comprising an additional spray nozzle, wherein said spray nozzle and said additional spray nozzle are to rinse both of top and bottom surfaces of the polished workpiece, respectively.

5. A polishing apparatus comprising:

a polishing table;

at least one top ring for holding a workpiece during a polishing operation;

cleaning units for cleaning a polished workpiece at multiple stages;

a temporary storage station for receiving a polished workpiece; and a first robot for transferring the polished workpiece to said temporary storage station; and a second robot for transferring the polished workpiece from said temporary storage station.

6. A polishing apparatus comprising:

polishing tables;

a top ring device including top rings, each of said top rings for holding a workpiece during a polishing operation; and a pusher for transferring a workpiece between said top ring device and said pusher, wherein one of said polishing tables is constructed and arranged to perform water polishing of a workpiece to thereby concurrently perform finishing and cleaning of this workpiece.

7. The polishing apparatus according to claim 6, wherein said top ring device is constructed and arranged such that when one of said top rings is positioned above said pusher, to remove a workpiece therefrom, another of said top rings is positioned to hold a workpiece to allow this workpiece to be polished by one of said polishing tables.

8. The polishing apparatus according to claim 6, wherein said top ring device comprises a support shaft, and a swing arm fixed to said support shaft and supporting said top rings.

9. The polishing apparatus according to claim 8, wherein said polishing tables are provided around said support shaft so that said top rings can access all of said polishing tables by rotating said support shaft.

* * * * *